US005335850A

United States Patent [19]

Igwemezie

[11] Patent Number: 5,335,850

[45] Date of Patent: Aug. 9, 1994

[54] ATTENUATING PAD FOR CONCRETE RAILWAY TIES

[76] Inventor: Jude O. Igwemezie, 2902 - 95 Thorncliffe Park Drive, Toronto, Ontario, Canada, M4H 1L7

[21] Appl. No.: 864,713

[22] Filed: Apr. 7, 1992

Related U.S. Application Data

[63] Continuation of Ser. No. 447,862, Dec. 8, 1989, abandoned.

[51] Int. Cl.[5] ..... E01B 9/68

[52] U.S. Cl. ..... 238/283; 238/382

[58] Field of Search ..... 238/283, 284, 285, 382, 238/304, 306; 267/153, 136, 140, 141, 292; 248/560, 633, 634

[56] References Cited

U.S. PATENT DOCUMENTS

| | | | |
|---|---|---|---|
| 4,618,093 | 10/1986 | Young et al. | 238/283 |
| 4,648,554 | 3/1987 | McQueen | 238/283 |
| 4,696,429 | 10/1987 | Ortwein | 238/382 |
| 4,771,944 | 10/1988 | Brister et al. | 238/283 |

FOREIGN PATENT DOCUMENTS

| | | | |
|---|---|---|---|
| 2504165 | 8/1976 | Fed. Rep. of Germany | 238/283 |
| 1211567 | 10/1959 | France | 238/283 |
| 1380302 | 10/1964 | France | 238/283 |
| 9008224 | 7/1990 | PCT Int'l Appl. | 238/283 |
| 323496 | 2/1972 | U.S.S.R. | 238/283 |
| 611753 | 11/1948 | United Kingdom | 238/283 |

*Primary Examiner*—Michael S. Huppert
*Assistant Examiner*—James T. Eller, Jr.

[57] ABSTRACT

A railway tie pad is provided with studs that are either offset from opposed positions from each other, on opposite sides of the pad; or are of differing heights. Pads with these features are capable of being more efficient in isolating ties and rails from shock loading, and in accommodating varying loads with differing cushioning characteristics.

14 Claims, 9 Drawing Sheets

FIGURE 1A
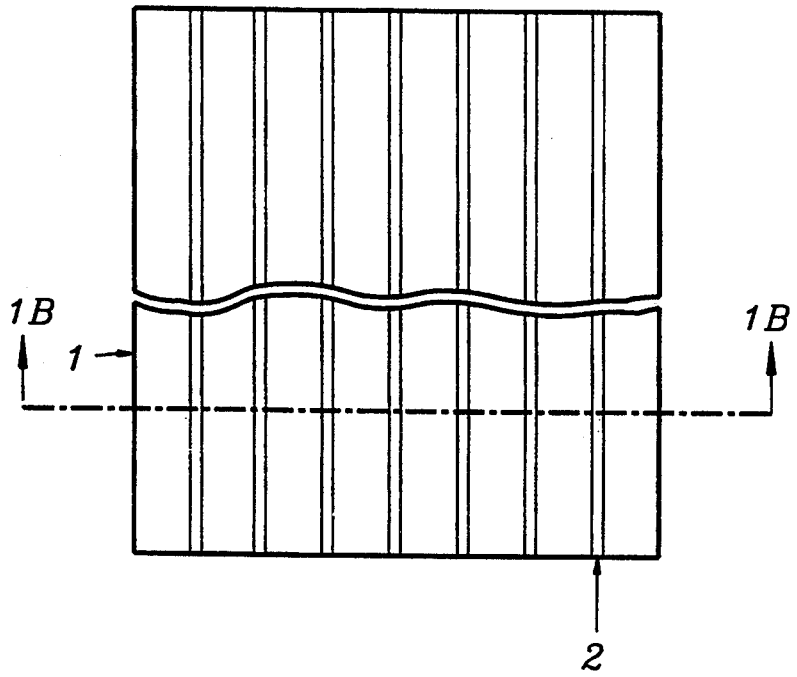
PRIOR ART
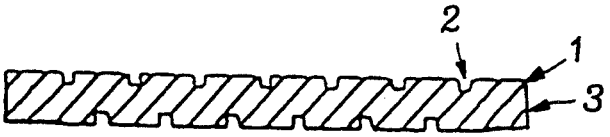
PRIOR ART
FIGURE 1B

FIGURE 2A
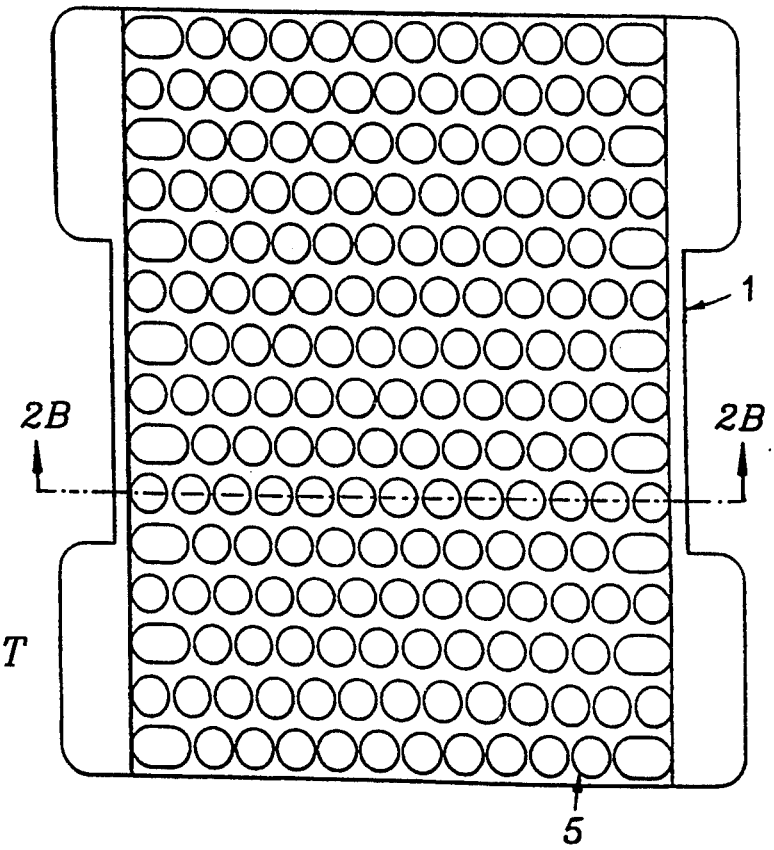
PRIOR ART
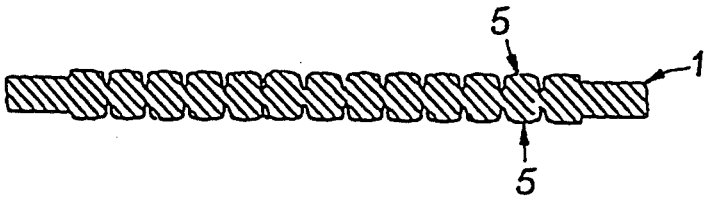
PRIOR ART
FIGURE 2B

FIGURE 3A
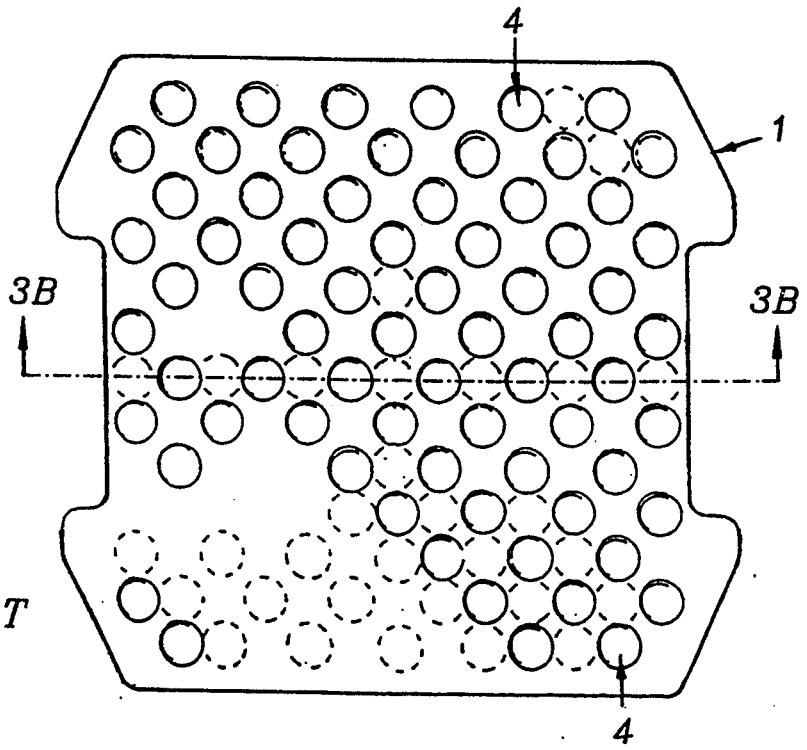
PRIOR ART
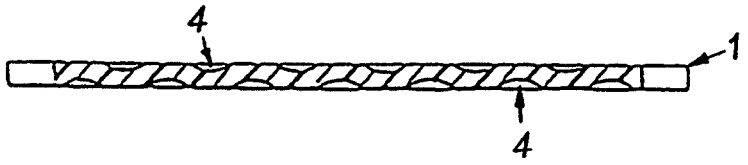
PRIOR ART
FIGURE 3B

FIGURE 4A
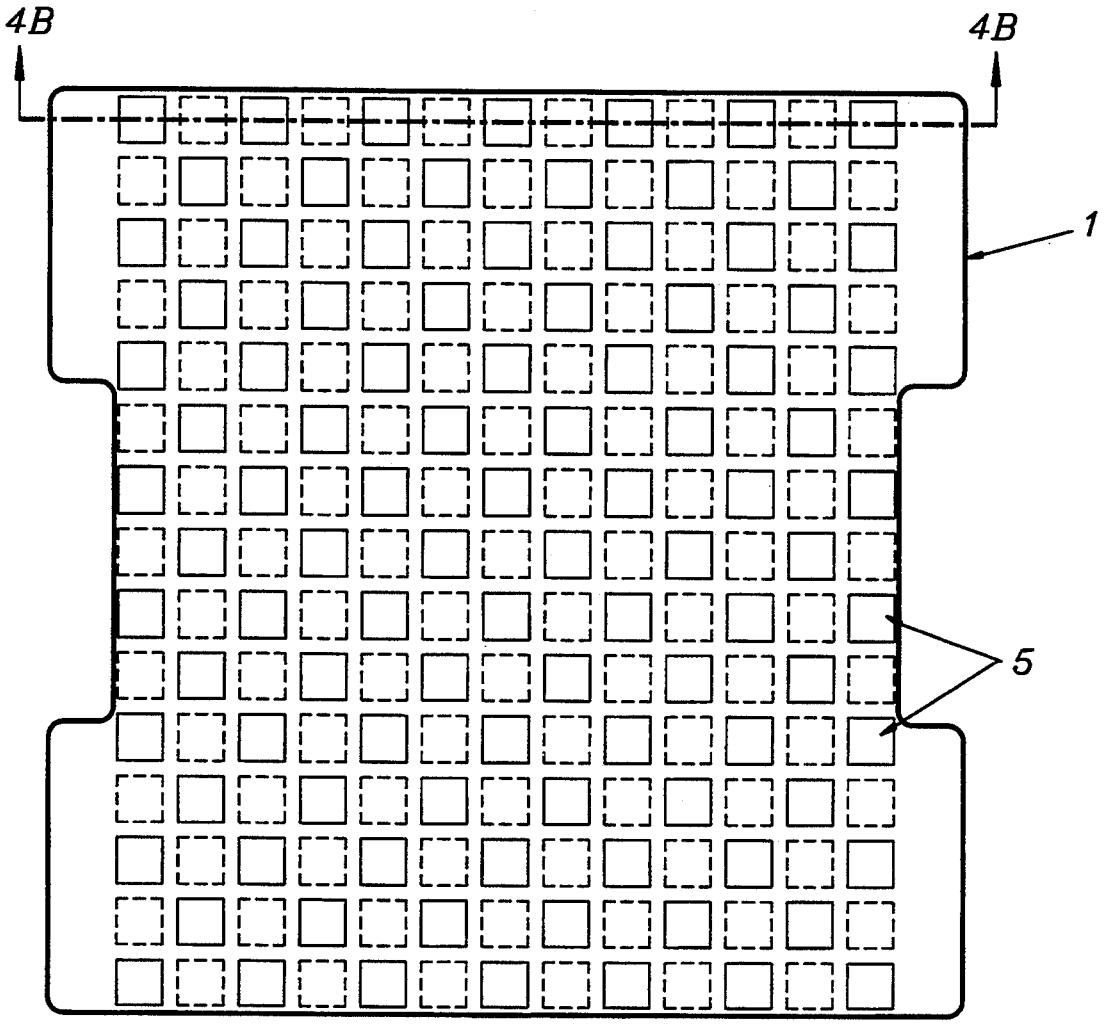
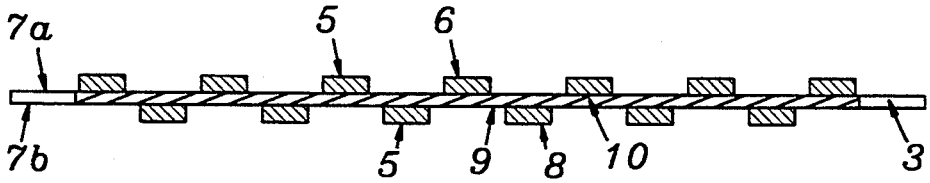
FIGURE 4B

FIGURE 5A
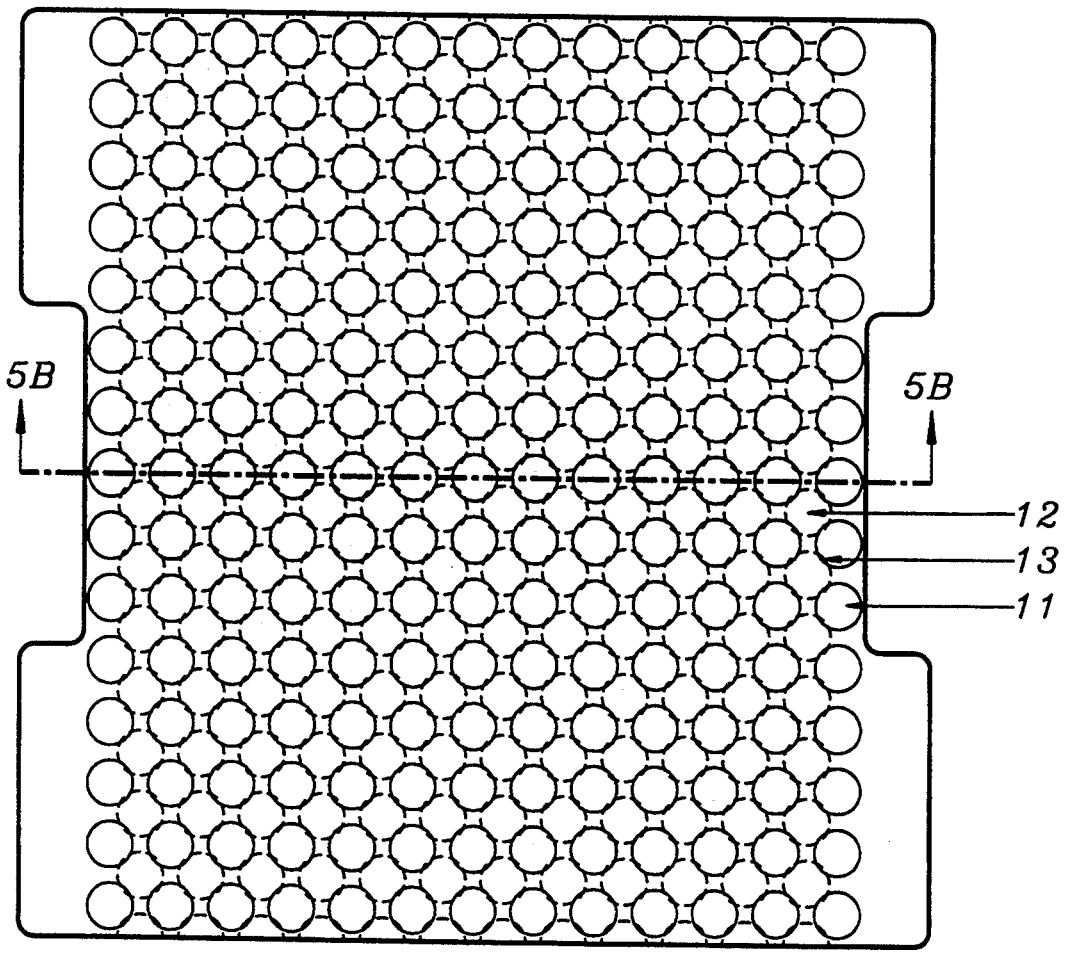
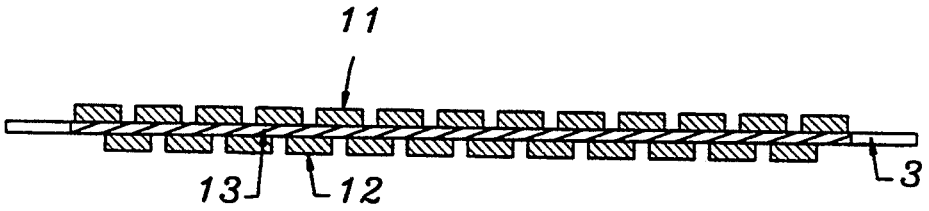
FIGURE 5B

FIGURE 6A
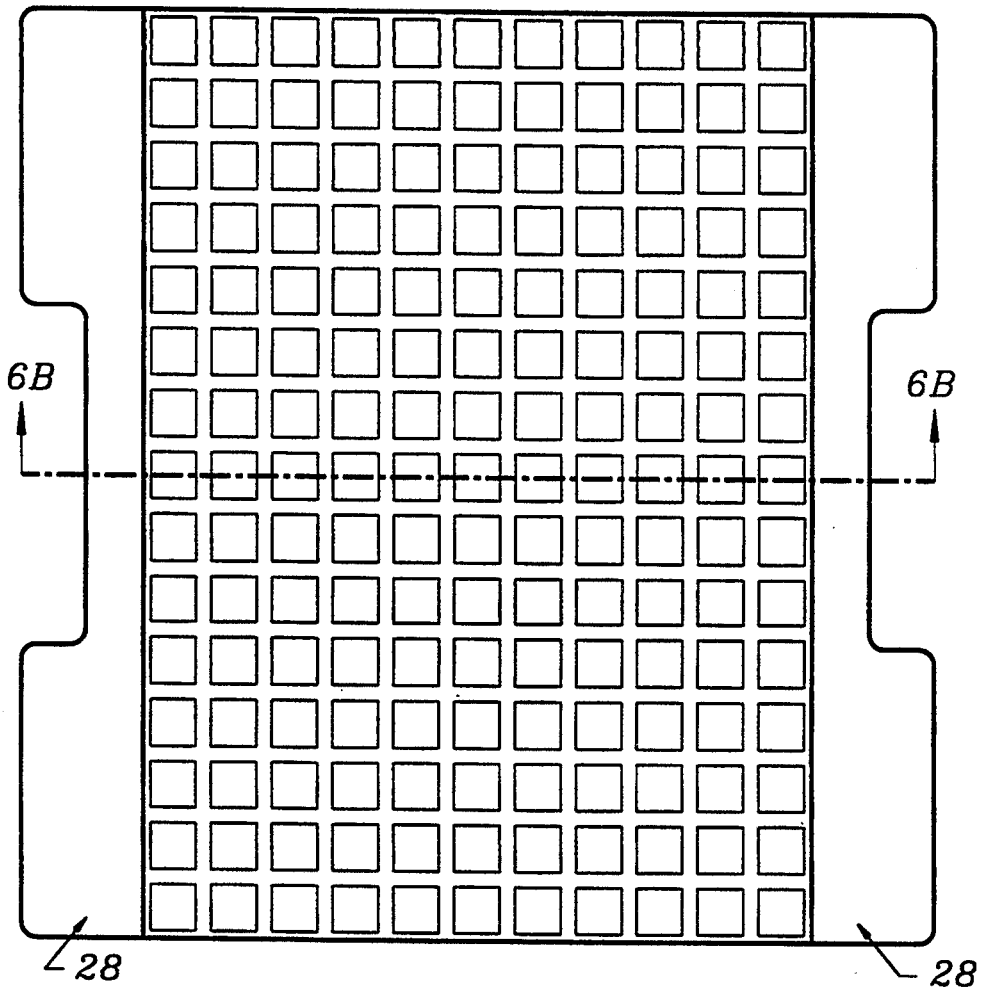
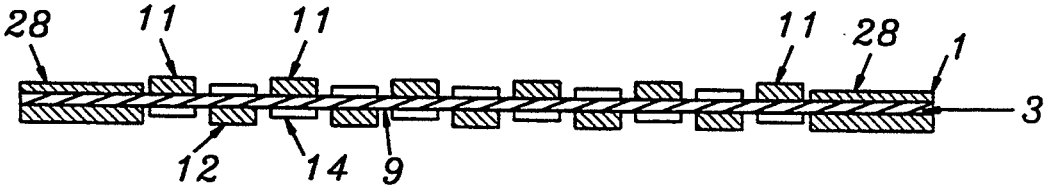
FIGURE 6B

FIGURE 7A
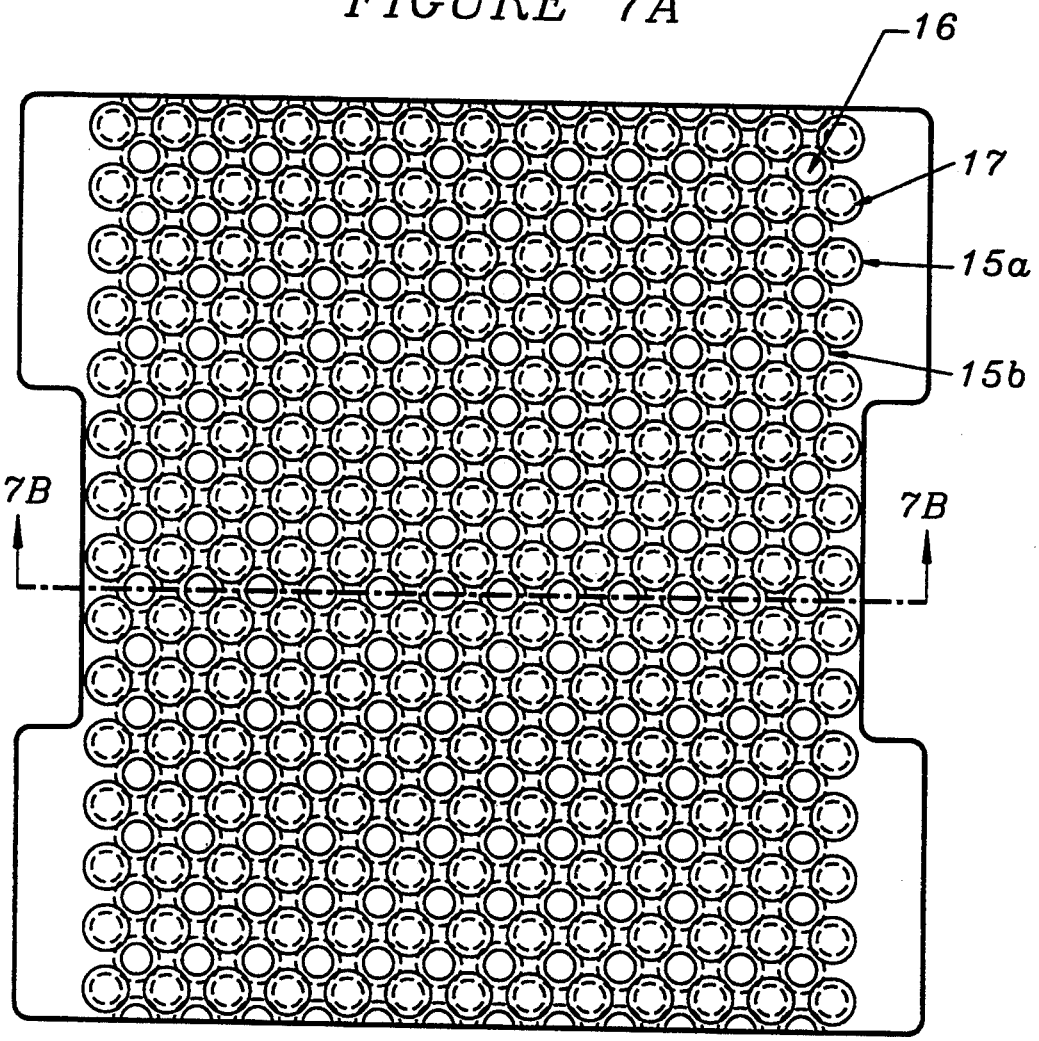
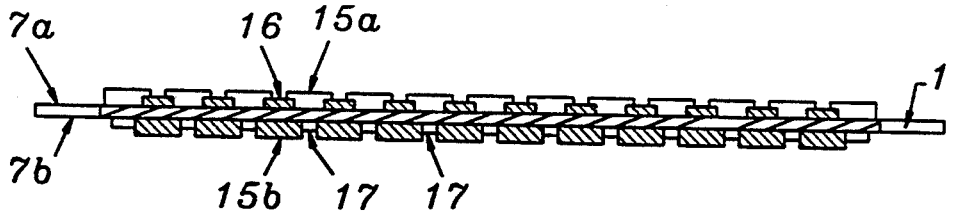
FIGURE 7B

FIGURE 8A
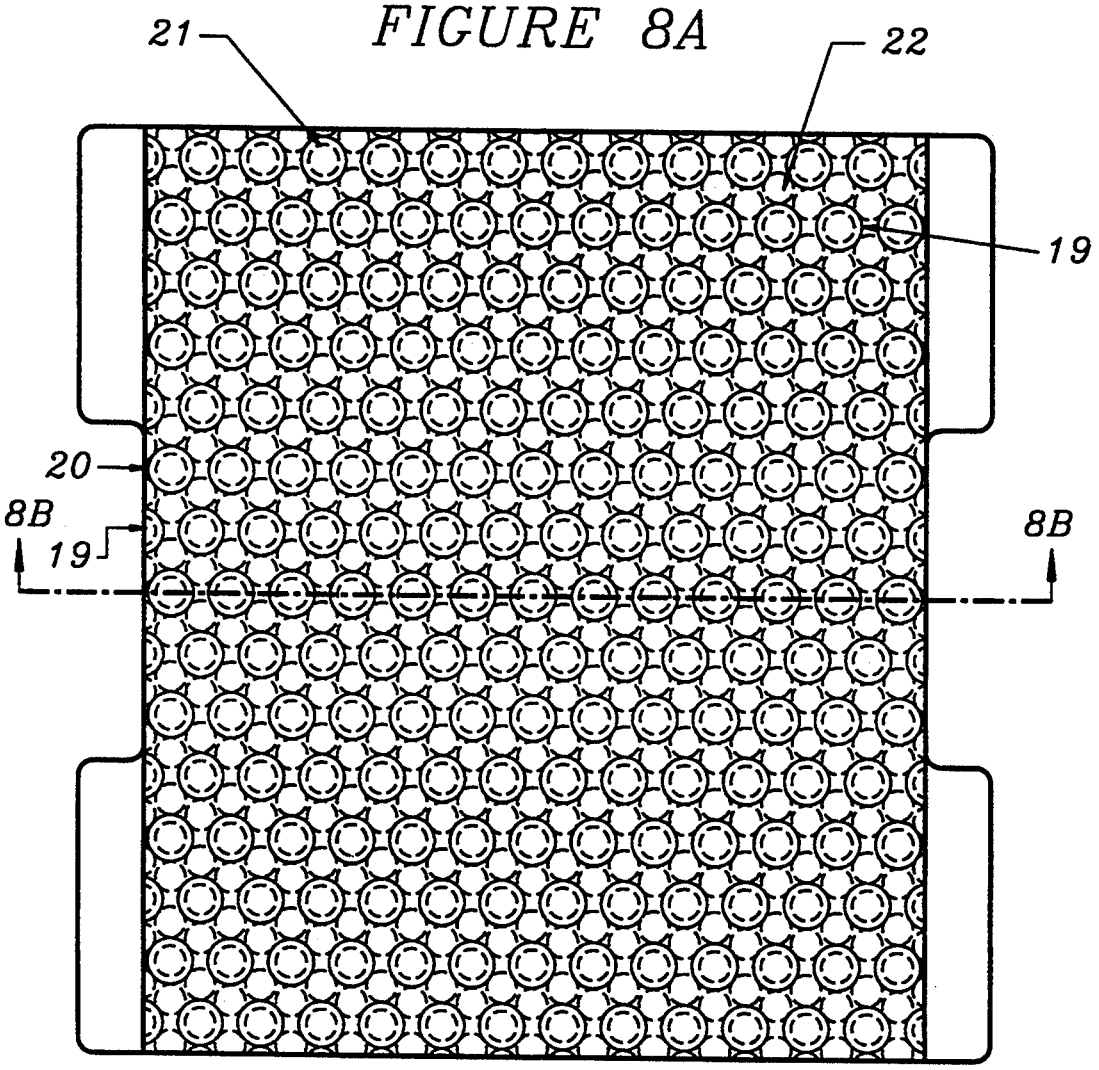
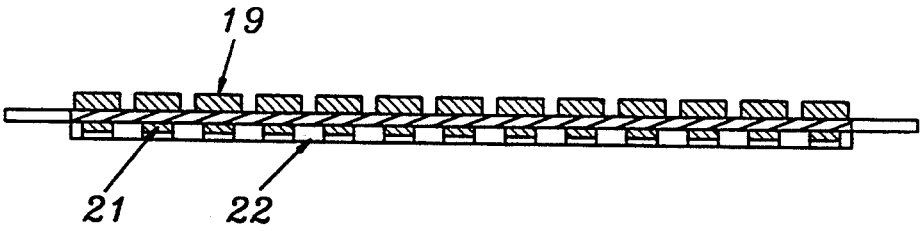
FIGURE 8B

FIGURE 9
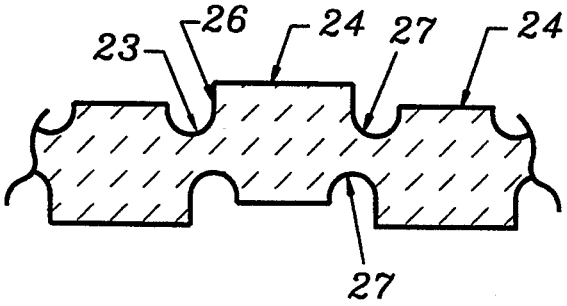
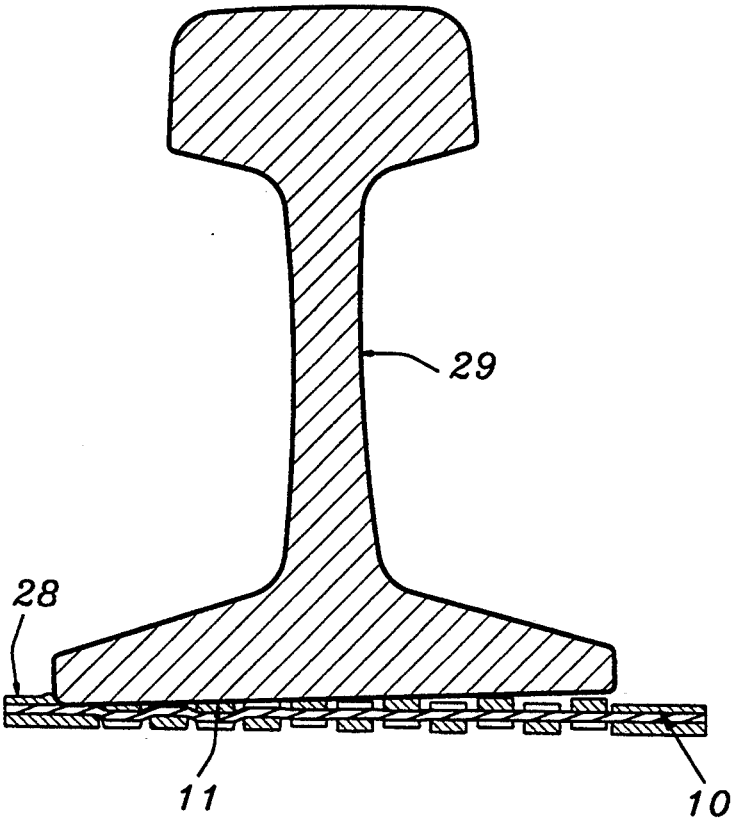
FIGURE 10

ATTENUATING PAD FOR CONCRETE RAILWAY TIES

This is a continuation of application Ser. No. 07/447,862, filed Dec. 8, 1989, now abandoned.

FIELD OF THE INVENTION

This invention relates to pads for concrete railway ties. More particularly, it relates to improvements in the shape of such pads with the object of attenuating the dynamic loads generated by train wheel surface anomalies and the resulting stresses to which vehicle components (wheels, bearings etc.) and track components (concrete railway ties, rails) are exposed.

BACKGROUND TO THE INVENTION

Under the action of good wheels and a level track or bridge system, the distribution of train wheel loads on the concrete ties, according to the conventional wisdom, depends on:

(a) the tie spacing;

(b) the ballast stiffness or the stiffness of the tie-girder bearing pads in the case of open deck bridges; and (c) the size of the rail. Changing the size of the tie and the characteristics of rail-tie pad has not generally been thought to have a significant effect on the distribution of train wheel load on concrete ties. This invention concerns improvements to the pads in ways not previously perceived as being available.

In practice, track and bridge ties are subjected to moving axle loads. Because of the vehicle speed, wheel imperfections and random differences of levels and other differences in the field, the dynamic load transmitted to the concrete tie is much higher than the static load. This increase over the static load manifested itself in 1980 along the North-East rail corridor (between Washington D.C. and Boston) where concrete track ties were found to have developed hairline cracks only a few months after their installation. It should be noted that concrete ties normally are thought to have a projected life expectancy of 50 years. Similar experiences of tie failure have been reported by the Canadian, European and Japanese railways.

To accommodate this increase of dynamic loads over the static load and the resulting risk of damage, the code committees in various countries use the so called "Impact Factor", (I.F.), in concrete tie design to accommodate for the dynamic component of the railway track loading. In North America, an Impact Factor of 60% (excess design load over 100% static load capacity) was initially recommended by the Association of American Railroads (AAR). The disappointing performance of concrete ties designed with the 60% increase factor led to a recommendation by the AAR for an "Impact Factor" (I.F.) of 150% which is presently used today. Yet concrete ties designed with the 150% Impact Factor have suffered the same fate as their predecessors. Presently, a new proposal has been tabled by some members of the AAR asking for an increase of the Impact Factor to 200%.

To understand the nature of distribution and attenuation of dynamic (especially impact) loading, attention must be paid to the effects of rail-to-tie pad stiffness and tie-to-girder pad stiffnesses.

It has been found that the dynamic over-loading of concrete ties is not influenced by the train speed, provided that the train wheels are smooth and have no surface irregularities, such as "shells" or flats. When these are present on the wheel running surface, the response of the concrete tie to the wheel loading has been observed to be dependent on the train speed and the impact load is dependent on the unsprung mass of the train-wheel set. At low speeds (0–40 mph), (0–64 km/h), there can be a complete unloading of the ties followed by impact. At high speeds (above 50 mph {80 km/h}), particularly in the case of lighter passenger trains, the wheels can become temporarily airborne for a very small time interval, and then impact on the rail a number of times on landing. This creates very high dynamic loads not only on the supporting tie, but also on other track and vehicle components.

To protect concrete ties and to reduce the probability of rail or wheel fractures or shelling due to the impact resulting from the wheel defects on the various trains, the EVA (Ethyl Vinyl Acetate) pad, a solid and very stiff (stiffness=10800 kips/in) pad, was developed by Pandrol Limited in Britain. This pad has been used extensively between rails and concrete ties. Research findings have shown, however, that solid pads and other equivalently stiff pads transmit enough impact energy to cause cracking of concrete ties. Solid, stiff pad designs commercially available do not afford the degree of protection for ties that would be desired by the railways. As indicated previously, in some cases, the concrete ties have developed cracks less than six months after being put into service.

Attempts in the past to improve the performance of the tie-pads have included the selection of certain surface profiles, such as linear grooves, perforations, surface patterns in the form of directly opposed studs and shallow dimples.

Prior patents that have addressed these issues are as follows:

U.S. Pat. No. 2,656,116—Protzeller assigned to Arthur Wm. Nelson (perforations)

U.S. Pat. No. 4,254,908—Matsubara assigned to Tokai Rubber Industries Ltd. (offset grooves)

U.K. 2,161,524—Brister et al, issued to Pandrol Limited (opposed studs)

U.S. Pat. No. 4,648,554—McQueen, issued to Acme Plastics Inc. (offset dimples)

The effect of such profile variants has been to provide pads that substantially absorb applied loads by undergoing compression. Design control over the response of such pads under compression is, however, limited.

Ideally, a railway tie pad should be capable of both absorbing the equivalent static load of a heavy, slow-moving freight train, and the dynamic, high frequency, shock loading created by higher speed trains. Such dual characteristics are not easily found in a single pad design.

This invention achieves an improvement in the design for the rail-tie pads by controlling the stiffness of the pad under such variable conditions. This is done by modifying its shape in order to improve the attenuation of impact loading. Tie pads made in accordance with the invention rely on the creation of shear stress within the pad and/or novel surface profiles to provide a means for creating a multi-stage response function that is suitable for sustaining both light and heavy loads and, at the same time, attenuating high frequency dynamic stresses.

These and further features of the invention will be apparent from the description which now follows.

SUMMARY OF THE INVENTION

According to the invention tie-pads are provided with studded upper and lower surfaces laid over a central core wherein respective studs on opposed sides of the pad are substantially off-set from vertical alignment with each other so as to permit the formation of bending and shear stress in the core of the pad and compressive stresses in the studs when the pad is subjected to loading.

By a further feature of the invention, the studs provided on the pad surfaces are of differing lengths so that, upon progressive loading of the pad, studs of differing lengths are progressively exposed to loading.

In a further aspect of the invention a tie-pad is provided having on at least one side of the pad a mixed field of two classes of studs consisting of: (1) a first class of primary studs of greater height off the pad core and (2) a second class of secondary studs of a lesser height off the pad wherein the primary studs are substantially offset from vertical alignment with the corresponding primary studs on the opposite side of the pad core, and the secondary studs are substantially vertically aligned with the corresponding primary studs on the opposite side of the pad core whereby when the pad is progressively loaded, the primary class of studs absorb loading first, followed by the secondary class of studs.

These and further features of the invention will be apparent from the descriptions of the preferred embodiments which now follow.

SUMMARY OF THE FIGURES

FIG. 1 is an example of a prior art pad with linear grooves;

FIG. 2 is an example of a prior art pad with opposed studs;

FIG. 3 is an example of a prior art pad with dimples;

FIG. 4 is an example of a pad according to the invention with offset studs;

FIG. 5 is a pad according to the invention with slightly overlapping opposed studs;

FIG. 6 is a pad with studs of primary and secondary heights on opposed sides of the pad;

FIG. 7 is a pad in which the primary and secondary studs are of differing diameters;

FIG. 8 is an alternate arrangement for studs of differing diameters; and

FIG. 9 is a cross-sectional view of studs showing filleting in the corners.

FIG. 10 is a cross-section of a rail mounted on a pad that is adapted to resist the canting of the rail.

Where face and sectional views are provided of the same pad, the face view is designated by "a" and the sectional view by "b".

DESCRIPTION OF THE PREFERRED EMBODIMENTS

FIG. 1 shows a known configuration of pad 1 with linear groves 2. The grooves 2 are spaced so that the core 3 of the pad 1 is generally subject to compression on loading. In such pads, strain is typically a linear function of stress.

FIG. 2 shows another known pad 1 configuration in which pad 1 is provided with a series of studs 5 mounted on opposed sides of the pad 1 in substantial vertical alignment with each other.

FIG. 3 shows a further known pad configuration in which the pad 1 is provided with shallow dimples 4 on opposed sides of the pad 1. The dimples 4 are distributed in such a manner that the core 3 of the pad is substantially in a state of compression when loaded.

FIG. 4 shows a pad 1 according to one aspect of the invention whereby the pad 1, of generally planar proportions, has studs 5 formed on opposed sides in an off-set manner. Thus a specific stud 6 on the upper side *7a* is not directly over a stud on the lower side *7b*. The most proximate stud 8 on the lower side *7b* is off-set from alignment with the upper stud 6.

FIG. 4 shows a case where the off-set is total. That is, there is no vertical overlap between the upper 6 and lower studs 8. This results in shear and bending stress developing within the core 3 in the stress region 9 between the two studs. With the selection of suitable materials for the body or core 3 of the pad, the stress region 9 will deform elastically under load. Such deformation will exhibit a differing level of stiffness than would arise from the compression of the studs 6, 8.

The core should be made of a resilient material, capable of bearing a degree of tension resiliently, as well as being resiliently resistant to compression. Further control over the level of stiffness arising from deformation of the off-set region 9 may be provided by including a fibre matrix 10 within the core of the pad which is adapted to enhance its ability to resist, resiliently, tensile stress.

The degree of offset shown in FIG. 4 has been exaggerated for clarity. To provide a high bearing surface for a rail, the degree of offset should be minimal.

FIG. 5 shows a pad with upper and lower studs 11 and 12 in which the off-set is less than total. Also, studs of optional circular form are shown. In this case, a small degree of overlap occurs in the overlap region 13 that lies between the edges of the upper and lower studs 11 and 12. This overlapping allows an array of studs of higher density to be formed, increasing the bearing surface area of the pad. The studs are optionally laid-out so that the overlap occurs along diagonals. By providing a small degree of overlap, a mixed condition of compression and shear stress can be created within the pad core 3. This provides a means to reduce the rate of onset of deformation under load that will arise from bending around the overlap region 13.

The preferred maximum degree of overlap, where overlap is provided, that is believed suitable in this application is between 0 and about 20% of the surface area of the studs. Where a single larger upper stud is opposed by several lower studs of smaller diameter, the total overlapped area for the upper, larger stud may be as much as 50%. However, a significantly greater degree of overlap will produce a pad in which compressive resistance to loading predominates, and in which the benefits of creating a bending stress will be significantly reduced.

The pad of FIG. 5 is capable of absorbing shock loads to a superior degree by reason of the reduced stiffness of such a pad, achieved by providing the studs' material with more space to deform into, as compared to a pad of the types of FIGS. 1 to 3. The improved performance of the studs resulting from the extra space for the material to deform-into arises from the fact that rubber like materials has poisson ratio close to 0.5 and thus does not under go a volumetric change under load. The bearing surface of the pad of FIGS. 4 & 5 is, however, reduced. Under light loads the surface area may suffice. To protect this pad from excessive distortion under heavy loads, and to allow the pad to accommodate heavy loads, a further optional feature may be provided.

FIG. 6 shows a pad 1 in which an additional shorter stud 14 is placed in the gap below an upper stud 11. This stud 14 is shorter than the adjacent full-height stud 12. The result is that on loading of the pad, the shorter stud limits the degree of deformation that will occur in the off-set regions 9, or overlapping regions 13 in FIG. 5*a,b*, as the case may be. This shorter stud 14 serves to prevent the over-stressing of such regions beyond the elastic limit of the material in the core 3.

It is not necessary in this configuration that all studs of the greater height be offset from the corresponding full-height studs on the opposing side. A mixed field of studs of greater and lesser heights will provide a progressive resistance to loading, whether or not bending stresses are created. It is preferable, however, that the creation of some bending stresses be present.

FIG. 7 shows a pad in which a first set of higher, primary upper studs 15*a*, constituting a field of studs, are interspersed on the same upper side 7*a* of the pad with a second set of shorter, secondary studs 16 of a lesser diameter, constituting a second field of studs. A similar but offset pattern of studs is provided on the lower side 7*b* of the pad 1. Thus the field of wider, upper primary studs 15*a* are opposed on the side opposite by a field of secondary studs 17 of shorter height than the primary lower studs 15*b* on the lower side 7*b*. These secondary studs 16,17 are all of a height suitable to reduce the risk of excessive deformation of the core 1, while permitting bending strain to arise within the core 1. At the same time this lower secondary stud 17 is surrounded by larger diameter primary studs 15*b* which induce bending strain when the pad is initially, or lightly, loaded.

The use of alternate studs of differing diameters as well as heights allows for a higher density of studs to be formed, increasing the bearing surface, while still providing a means to influence stiffness. Once again, the offset between primary upper and lower studs allows the pad to absorb loads partially through bending, while the secondary studs limit the degree of deformation under bending stress, thus protecting the pad from excessive distortion and improving the pads capacity to handle heavy loads.

An even higher density array of studs of mixed diameters and heights is shown in FIG. 8. In this example, the wider, upper studs 19 are laid-out in staggered rows 20. Each upper stud 19 is opposed on the lower side by a secondary stud 21 of a diameter that is less than that of the upper stud 19.

Surrounding each secondary stud 21 on the lower side is an encircling array of primary lower studs 22 that are offset from the upper studs 19, and are of a smaller diameter than such upper studs 19. Thus, the lower primary studs 22 are not opposed by a secondary stud on the upper side. And the bearing area of primary studs 22 on the lower side exceeds that of the secondary studs 21 on the lower side.

In all of the foregoing drawings the studs, whether of a round or rectilinear cross-section, have been shown as having vertical walls and sharp corners and edges. These are not essential characteristics. The corners 23 of the studs 24 at the base of the stud walls 26 may be filleted 27 for ease of manufacture, and to reduce stress concentration and subsequent crack formation. This is shown in FIG. 9.

Studs have been shown which are round and square in cross-section. These shapes are not critical to the functioning of the invention. Studs according to the invention may be rectilinear in cross-section, e.g. hexagonal, or have continuous curvature e.g. elliptical. While studs may have both positive and negative curvature in the shape of their outer walls in cross-section (a circle being defined as having positive curvature) it is believed that studs of positive curvature are to be preferred as providing greater freedom for the walls of the studs to bulge or expand on compression.

Further, while the studs shown are all depicted as being substantially free-standing from each other, the effects of creating bending stresses will still be obtained even if the studs are linked by bridging elements. Such bridging elements should not, however, be so extensive as to eliminate the creation of bending stresses, which are a preferred characteristic of the invention.

In selecting a configuration for a stud pattern, it is desirable to present a high surface area on the stud ends facing the directions of applied forces, i.e. up and down; while providing sufficient space between the studs to allow for expansion of the stud walls through bulging under load. It is further thought that near-vertical walls are preferable as providing improved expansion freedom for the walls on compression, although such a feature is not essential.

The optimum material for producing the pads according to the invention will be known to those engaged in the art. Essentially, pads should be made of polymeric material with high elasticity and low damping characteristics, such as hard cured rubber, and modern synthetic equivalents.

FIG. 6 shows one further pad variant adapted for use on corners and curves on a railway track. The pad 1 in FIG. 6 is provided with a partially elevated outer support region 28 which is intended, by reason of the absence of studs, to have a greater stiffness than the studded region of the pad. This outer support region 28 should also be of slightly less height than the adjacent primary studs 11. The object is to provide support for the outer edge of the rail bottom when a rail 29 is slightly canted by a sideways force. This effect is shown in FIG. 10. Once the adjacent primary studs 11 are partially compressed, the rail 29 will bear on the relatively incompressible outer support region 28 of the pad 1 and resist further canting of the rail 29.

In this configuration, the outer support region 28 is made of the same material as the studs 11, thereby having the same intrinsic compressibility. This allows for the pad to be molded with a single material for each element. The variation in stiffness between the studded region and the outer support region 28 arises only from the differences in their geometric configuration. Because reduced stiffness for the studded region arises due to the freedom of the studs to bridge and for bending strain to develop (due to the offset arrangement of studs) the studs and outer support region may be made of a more incompressible material. This provides flexibility in design to ensure that the outer support region 28 is sufficiently stiff to serve its function.

This arrangement represents an improvement that may be used in conjunction with offset studs to improve a pad of such configuration. But this arrangement will also serve usefully whether or not the studs are offset. The ability to utilize material of the same compressibility for the central region of the pad as well as the outer support region 28 arises so long as the overall compressibility of the central region is reduced by geometrically interrupting the pad surfaces in this region to provide fields of more highly compressible studs. Such studs need not be offset, but may be opposed, in whole or in part.

SUMMARY

The effect of the invention is to provide a railway tie-pad which has increased capacity to absorb dynamic or shock loading. Further features include the capacity to provide multiple spring action adapted to accommodate heavy static (or rolling) loads, and capable of improved dissipation of dynamic (or impact) loads when the pad is less heavily loaded.

The theory behind pads made according to the invention is that it is desirable to provide a pad of reduced compressivity, lower modulus of elasticity and low damping characteristics in order to attenuate impact loads. At the same time, provision may be made to ensure that the pad is not liable to excessive deformation under higher rolling loads.

Since resistance to compression increases with loading, impact loads are not accommodated as satisfactorily when a tie is heavily loaded as when a tie is lightly loaded. Such loss of impact resistance is, in existing pads, presently approximately a linear, or at least a continuous, function of loading. This invention provides means to varying the schedule of resistance exhibited by a pad under progressive loading, thereby providing greater control over the capacity of such a pad to dissipate impact loads.

When pads according to the invention are subject to light loads, e.g. passenger trains, such pads are relatively compressive and effective. Under such conditions, pads according to one aspect of the invention have lower stiffness and a higher capacity to absorb shock stresses.

Under heavier rolling loads, e.g. fright trains, the pad of the invention, in a further version, deforms past its low stiffness condition and become stiffer. In such a condition, the pad is still able to at least partially dissipate impact shocks to an improved extent. This is because for the shock loading to be imparted onto the rail, there has to be a prior partial or complete unloading of the rail. When unloaded the pad immediately springs back to its highly elastic (low stiffness) state in readiness to receive the impact (shock). At the same time these pads can sustain the heavier rolling load. After the heavy rolling load has passed, these pads are able to resume their low stiffness state, and thus are able once again to show improved dissipation of impact loads.

The foregoing has constituted a description of exemplary embodiments of the invention. These are examples only. The full scope and character of the invention is further described and defined in its broadest and more specific applications in the claims which now follow.

The embodiments of the invention in which an exclusive property or privilege is claimed are defined as follows:

1. A railway tie pad adapted to progressively absorb increasing degrees of loading comprising:

(a) a central core of relatively planar proportions having first and second opposed sides and being composed of resilient, shear resisting material, and (b) a plurality of protruding studs composed of resilient compression-resisting material, distributed over said first and second sides of said core, wherein said studs distributed across said first side of the pad comprise a first class of primary studs of a given height above the first side, interspersed with a second class of secondary studs of lesser height above the first side, and wherein the studs on the second side of the pad comprise offset studs which are offset from said primary studs and opposed by said secondary studs so that, upon progressive loading of the pad, bending and shear stress form in the core and the interspersed secondary studs of lesser height are progressively exposed to loading.

2. A railway tie pad as in claim 1 wherein substantially all of the studs are free standing each from the other without interconnection therebetween above said core.

3. A railway tie pad as in claim 1 wherein substantially all of the studs have encircling sidewalls of outward convex curvature.

4. A railway tie pad as in claim 1 wherein the secondary studs are of lesser cross-sectional area than the cross-sectional area of the primary studs, and a plurality of primary studs are disposed around each of the secondary studs.

5. A tie pad as in claim 1 in which a portion of the studs on one side of said pad are of a greater cross-sectional area than a portion of the studs on the opposed side of said pad.

6. A tie pad as in claim 1 wherein the offset studs are offset from alignment with said primary studs for more than 50% of the cross sectional area of said studs.

7. A tie pad as in claim 1 wherein the offset studs are offset from alignment with said primary studs for more than 80% of the cross sectional area of said studs.

8. A railway tie pad adapted to progressively absorb increasing degrees of loading comprising a central core of relatively planar proportions with first and second sides, which core is composed of a resilient, shear-resisting material and is provided on the first and second sides of said core with mixed fields of protruding studs composed of resilient, compression-resisting material, each of said mixed fields on the respective sides of the core comprising:

(1) a first class of primary studs of a given height off the pad core, and (2) a second class of secondary studs of a lesser height off the pad core, wherein the primary studs of said mixed field on the first side are substantially offset from vertical alignment with the primary studs located on the second side of the core, and the secondary studs of the mixed field on the first side of the core are substantially vertically aligned with the primary studs on the second side of the core whereby, when the pad is progressively loaded, the primary class of studs absorb loading first, followed by the secondary class of studs, and bending and shear stress form in the core of the pad.

9. A railway tie pad as in claim 8 wherein substantially all of the studs are free standing each from the other without interconnection therebetween above said core.

10. A railway tie pad as in claim 8 wherein substantially all of the studs have encircling sidewalls of outward convex curvature.

11. A railway tie pad as in claim 8 wherein the secondary studs are of lesser cross-sectional area than the cross-sectional area of the primary studs, and a plurality of primary studs are disposed around each of the secondary studs.

12. A tie pad as in claim 8 in which a portion of the studs on one side of said pad are of a greater cross-sectional area than a portion of the studs on the opposed side of said pad.

13. A tie pad as in claim 8 wherein the primary studs are offset from alignment with each other for more than 50% of the cross sectional area of said primary studs.

14. A tie pad as in claim 8 wherein the primary studs are offset from alignment with each other for more than 80% of the cross sectional area of said primary studs.

* * * * *